United States Patent [19]

Josenhans

[11] 4,151,990

[45] May 1, 1979

[54] BILLIARD AIMING GUIDE

[76] Inventor: Frederick G. Josenhans, 14020 Netherfield Dr., Midlothian, Va. 23113

[21] Appl. No.: 834,620

[22] Filed: Sep. 19, 1977

Related U.S. Application Data

[63] Continuation-in-part of Ser. No. 681,552, Apr. 29, 1976, abandoned.

[51] Int. Cl.[2] ..... A63D 13/00; A63D 15/00

[52] U.S. Cl. ..... 273/2; 273/183 A

[58] Field of Search ..... 273/2, 3 R, 3 A, 6, 273/14, 203, 183 A, 33; 35/29 R

[56] References Cited

U.S. PATENT DOCUMENTS

| | | | |
|---|---|---|---|
| 1,936,625 | 11/1933 | Goldman | 273/203 |
| 3,220,122 | 11/1965 | Miller | 35/29 R |
| 3,410,555 | 11/1968 | Murch | 273/2 |
| 3,411,779 | 11/1968 | McGowan | 35/29 R X |
| 3,704,887 | 12/1972 | Thorton | 35/29 R X |
| 3,784,208 | 1/1974 | Weygandt | 273/187 A X |

FOREIGN PATENT DOCUMENTS

| | | | |
|---|---|---|---|
| 411373 | 6/1934 | United Kingdom | 273/2 |

*Primary Examiner*—George J. Marlo
*Attorney, Agent, or Firm*—Norman B. Rainer

[57] ABSTRACT

A device is provided for instructing and training in the aiming of a billiard cue ball for proper contact with an object ball. The device is a flat compliant structure having an elongated shape possessing symmetry about a longitudinal axis and comprising an object ball locator, an aiming pattern, and a pointer centered on said axis. The device is sufficiently thin so as not to deflect billiard balls during play, and small enough in size to be utilized near the corners of a billiard table playing surface.

9 Claims, 2 Drawing Figures

BILLIARD AIMING GUIDE

RELATED APPLICATIONS

This application is a continuation-in-part of application Ser. No. 681,552, filed Apr. 29, 1976, now abandoned.

BACKGROUND OF THE INVENTION

This invention relates to an improved training aid for use in improving a player's proficiency in the game of billiards, and particularly to a device and its manner of use for the self-instruction of a player with respect to his ability to cause one billiard ball to accurately strike a second billiard ball so as to cause the struck balls to move in precise paths.

Billiards games, including variations such as pocket billiards, pool and bumper pool, are generally played on a table having a rectangular playing area lined by resilient cushions. A number of hard spherical balls having a diameter of about 2¼ inches are disposed on the playing surface. A straight, tapered staff, generally called a cue stick, is utilized to strike the balls to cause desired motion thereof.

The usual object of the game is to strike one ball, generally referred to as the cue ball, with the narrow end of the cue stick in a manner such that the cue ball will roll toward and collide with another ball generally referred to as the object ball. The collision is intended to cause the object ball to move in a precise path from its initial resting position so as to fall into a pocket, collide with another ball, or assume a new location on the playing surface. It is also desirable to precisely ascertain the path and ultimate resting position of the cue ball following its collision with an object ball, whether for it to strike a subsequent object ball, or end its travel at a preferred position for further play, or to avoid a penalty from having it enter a pocket. "English", which is any rotation imparted to the cue ball by the manner in which it is struck by the cue stick, which rotation is other than normal rolling, may affect the path of the cue ball and/or the direction of the struck object ball and is to be avoided by one learning the game. English will, when imparted accidentally to the cue ball by an incorrect stroke, impair the player's ability to cause the object ball to travel as desired, although English may be used to advantage by advanced players.

In order to acquire satisfactory billiard skills, especially the aiming of the cue ball, it is necessary that proper techniques be repeated often enough so that they can be consistently executed. Suitable training aids must therefore be amenable to considerable repetitious use without causing inconvenience, promoting tedium, or imposing artificial restraints not encountered during actual playing of the game.

It is accordingly an object of the present invention to provide a device which will enable a billiard player to improve his proficiency in understanding where the cue ball location must be at the instant of contact with the object ball for the latter to follow a specific path.

Another object of the invention is to provide a device for placement on a billiards table which will afford instructive guidance for a billiards play and will allow for the repetition of said play by remaining in its original position during and after a play is made, with minimum interference to balls which may roll over it.

Another object of the invention is to provide a device which will enable a billiard player to improve his proficiency in understanding where the cue ball location must be at the instant of contact with the object ball for the former to follow a specific path after contact, and his understanding that said path may be altered by imparting English to the cue all when striking it with the cue stick.

Still another object of the invention is to provide a device useful in teaching the skill of aiming a billiard cue ball, said device being inexpensive and sufficiently small to be utilized in the presence of other playable balls and adjacent the corners of the playing surface of a billiards table.

A still further object is to provide a device of the aforementioned character which affords instructional guidance by visual alignment instead of physical manipulative steps, and useful in analyzing the effects of English imparted to a billiards cue ball. These objects and other objects and advantages of the invention will be apparent from the following description.

SUMMARY OF THE INVENTION

The objectives of the present invention are accomplished in general by providing a compliant thin sheet-like aiming guide structure having a generally elongated shape, the outer periphery of which possesses symmetry about a longitudinal axis. An object ball locator, having the form of an aperture or depression is located on said axis. An aiming pattern comprising visibly distinctive indicia or apertures radiating from a central point and having a generally circular outer periphery constitutes one extreme of said structure. Said central point lies on said axis and is positioned a distance from the center of said object ball locator equal to the diameter of a billiard ball to be used in conjunction with said aiming guide structure. The extreme of said aiming guide structure opposite said aiming pattern is provided with pointing means characterized in possessing a visibly distinctive symmetric bilateral taper terminating in a point-like apex on said axis and directed away from said aiming pattern. The underside of the aiming guide structure is provided with a surface having adhesive affinity for the playing surface of a billiards table.

In preferred embodiments, the aiming guide structure is fabricated of a single integral piece of film-like material, the upper side of which is provided with a surface affording frictional characteristics similar to those of the playing surface of a billiards table with respect to rolling movement of a billiard ball. The aiming pattern is preferably comprised of paired elongated indicia, preferably wedge-shaped, diametrically opposed and equiangularly disposed about said central point. In a particularly preferred embodiment of aiming pattern, the paired elongated indicia are symmetrically disposed about the longitudinal axis, with at least one pair of indicia being disposed perpendicular to said axis. In other preferred embodiments, the diameter of the circular periphery of the aiming pattern is greater than the distance between its central point and the center of the object ball locator, and one elongated indicia is bisected by said axis and disposed on the side of said central point opposite the side on which the object ball locator is positioned.

In a further aspect of the present invention, the aiming guide structure is utilized in conjunction with a separate device for marking the position of the cue ball on the billiards table, for multiple resetting of the original arrangement of the balls.

BRIEF DESCRIPTION OF THE DRAWINGS

In the accompanying drawing forming a part of this specification and in which similar numerals of reference indicate corresponding parts in all the figures of the drawing.

DETAILED DESCRIPTION OF THE INVENTION

Figure 1:
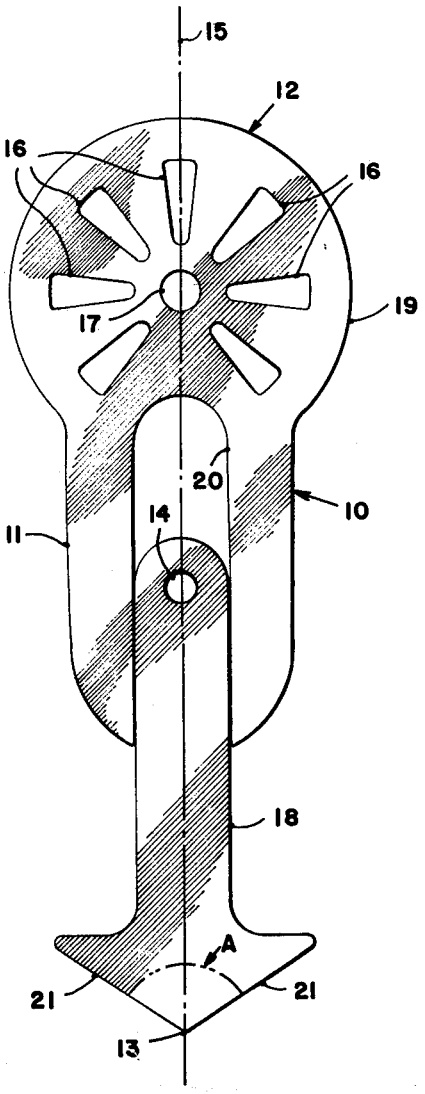
FIG. 1 is a plan view of a preferred embodiment of the aiming guide structure of the present invention.

Referring to FIG. 1, an aiming guide 10 is shown consisting of elongated body portion 11, aiming pattern 12, pointer member 18 having pointing terminus 13, and object ball locator aperture 14, said aiming guide having an overall configuration which is symmetrical about longitudinal axis 15. The aiming pattern 12 contains visually discernible radial indicia 16, and center indicia 17 positioned on axis 15. The indicia of the aiming pattern may consist of printed or textural modifications of the upper surface of the aiming guide structure, or may consist of cut-out regions. It is to be noted that the radial indicia 16 of the aiming pattern have an elongated wedge-like shape, the center axes of which, when extended toward each other, pass through the center of center indicia 17. Said radial indicia are therefore comparable to spokes emanating from a central point. Except for the single uppermost radial indicia, which is bisected by axis 15, the radial indicia in the embodiment of FIG. 1 exist as diametrically opposed pairs and are equiangularly spaced about center indicia 17 Although the radial indicia 16 of FIG. 1 are shown to have a sector or wedge-shaped configuration, other useful configurations may be employed such as straight lines, rectangles, and truncated triangles.

The outer periphery 19 of aiming pattern 12 has a circular contour interrupted at its lower extremity by merger with body portion 11. The circular portion of the outer periphery 19 of the embodiment of FIG. 1 extends for about 270° of circular arc. In general, it is intended that said outer periphery 19 have between about 250° and 320° of circular arc.

The body portion 11 will, in preferred embodiments, have a width, measured perpendicular to axis 15, which does not exceed the diameter of aiming pattern 12. The distance between the centers of object ball locator 14 and aiming pattern 12, both on axis 15, is equal to the diameter of the billiard balls with which the device of this invention is to be utilized. The embodiment of aiming guide exemplified in FIG. 1 is of two piece construction whereby pointer member 18 can be adjustably positioned within the slot 20 of body member 11. The feature of adjustability enables the spacing between the centers of the object ball locator and aiming patpern to be changed to accommodate balls of different sizes. Once adjusted, the pointer member 18 may be immoveably attached to body member 11 by scotch tape or equivalent means. In other embodiments however, the entire aiming guide structure may be of integral, monolithic construction having fixed centers of aiming pattern and object ball locator.

The pointing terminus 13 of pointer member 18 contains indicia comprising paired lines 21 symmetrically disposed about axis 15 and directed away from said object ball locator and toward convergence on said axis at an angle A of less than 160°. It should be noted that angle A is measured on that side of the intersection of lines 21 that faces the object ball locator. Lines 21 may be straight or curved and may be comprised of printed indicia or may constitute the outer periphery of the pointer member 18.

The aiming guide device of this invention is fabricated of a thin supple sheet material, preferably a film having a thickness between about 1 and 20 mils. Although the material must be sufficiently compliant to lay flat on any reasonably smooth surface, it must also have adequate dimensional stability so that it will not deform with continued use. Sheet materials thinner than about 1 mil generally lack adequate durability and dimensional stability. It has been found that sheet materials thicker than 20 mils will generally cause a deflection of a billiard ball, thereby defeating the purpose of the invention. Suitable sheet materials may be comprised of polymeric films such a polyester, polyolefin, polyvinylchloride, cellulose actate, and equivalent materials. The upper surface of the sheet material from which the aiming guide of this invention is fabricated will preferably have a felt-like surface resembling the surface of the billiards table. The purpose of such surface is to simulate the frictional characteristics of the playing surface of the table, so that balls rolling over the device will display the same characteristics of movement and impact as when on the regular playing surface. The felt-like surface may be formed by electrostatic floc deposition techniques or analogous methods.

The underside of the aiming device of this invention is preferably provided with a surface having mild adhesive affinity for other surfaces. This is achieved preferably by application to the underneath surface of the sheet material from which the device is fabricated of a contact-type adhesive composition having a tackiness capable of repeatedly bonding to and separating from other surfaces. Such adhesive materials are generally formulated from polybutene or polyterpene compositions and equivalents thereof. The adhesive strength of the underside of the aiming guide is sufficient to prevent movement of the aiming guide on the billiards table surface when a ball rolls over it, yet not strong enough to become permanently affixed to the felt surface of the billiards table. Without said adhesive surface, the thin film from which the aiming guide is fabricated, would curl, squirm or otherwise dislocate by the action of the rolling ball, and could even be lifted onto the ball by static electrical charges. When tested by a standard 1 inch strip adhesion test, the adhesive backing of the aiming device of this invention will register an adhesive force between about 0.1 and 20.0 pounds based upon one inch strips pressed together at their adhesive surfaces.

The aiming guide device of the present invention may be fabricated from sheet materials having the aforementioned characteristics by standard stamping or cutting methods. In packaging for storage and/or shipment, the device is preferably in flattened form attached to a relatively rigid surface.

Figure 2:
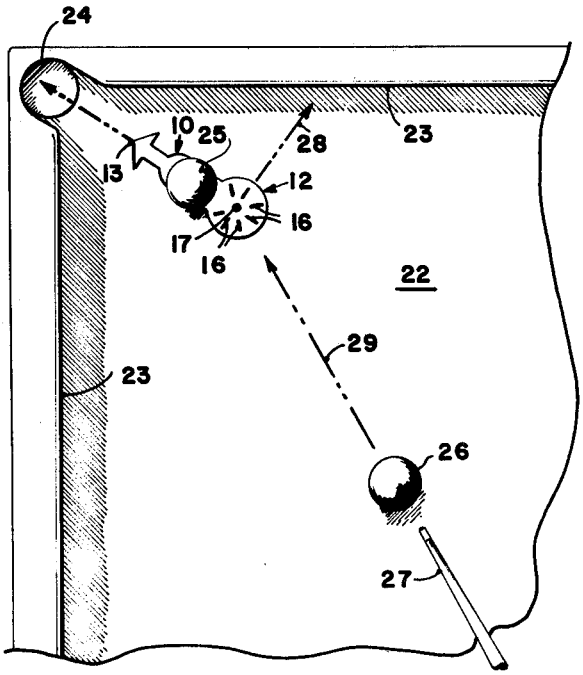
FIG. 2 is a plan view of the aiming guide of FIG. 1 disposed on a portion of a billiards table in association with properly positioned billiard balls and cue stick.

In FIG. 2, an aiming guide device 10 of this invention is positioned on the playing surface 22 of a billiard table bordered by resilient cushions 23. The aiming guide device is oriented such that pointing terminus 13 is directed at pocket 24. Object ball 25 is positioned on the object ball locator of the aiming guide device. A cue ball 26 is placed in any position on the playing surface that will allow the cue ball to reach center indicia 17 at the moment of contact with the object ball. The cue ball is then struck by cue stick 27 and the resultant effect is observed. If the cue ball was at center indicia 17 at the moment of contact and the object ball does not enter pocket 24 as desired, the possible affects of English will have to be considered. Once the needed correction for aim or execution in stroking cue ball 26 is ascertained, the player can repeat the play many times to secure an improved and feeling for the appropriate aim and stroke required for successful execution. Line 28 of FIG. 2 indicates the path of the cue ball 26 after striking the object ball 25. By observing said path relative to the spoke-like aiming pattern, the player can acquire improved judgment ability concerning the path and how it may be altered by English which may be imparted to the cue ball by the manner in which it is struck by the cue stick.

As a further aid to the player, one aspect of this invention contemplates the utilization of a marker device to accurately mark the correct position of the cue ball. Said marker device is preferably fabricated of the same material as that from which the aiming guide device is made.

The device of the present invention involves no moving parts. It lies flat upon the playing surface of the billiard table, and is left in place during the actual striking of the balls, causing no interference therewith. The device therefore affords a clearly discernible aiming guide which can be placed wherever desired on the billiards playing surface and removed therefrom without damaging said surface. In achieving the aiming function, the device provides two fixed tangible reference points which dictate the interpositional disposition of the balls at the instant of impact to propel the object ball in the desired direction. The relatively small size of the device permits its use in corner regions of the billiards table, and amongst other playable balls, and with object balls located touching the cushions.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

Having thus described my invention, what is claimed is:

1. A training device for the aimining of a billiard ball comprised of compliant sheet material of uniform thickness having a generally elongated shape consisting of a body portion bounded by two extreme portions and an outer periphery possessing symmetry about a longitudinal axis, an object ball locator having the form of an aperture or depression centered on said axis within said body portion, an aiming pattern of generally circular boundary configuration constituting one extreme portion of said device and having visibly distinctive indicia radiating from a central point lying on said axis at a distance from the center of said object ball locator equal to the diameter of a billiard ball to be used in conjunction with said device, and pointing means adjacent the other extreme portion of said device and possessing a visibly distinctive symmetric bilateral taper culminating in an apex positioned on said axis and directed away from said aiming pattern, the thickness of said sheet material being not greater than 20 mils so that a billiard ball will not be significantly deflected when rolling over game on a billiard table surface.

2. The device of claim of claim 1 wherein the diameter of the generally circular boundary of said aiming pattern is greater than said distance between said central point and the center of said object ball locator.

3. The device of claim 1 fabricated from a single integral piece of compliant thin sheet material.

4. The device of claim 1 wherein the underside of said device is provided with a surface having adhesive affinity for the playing surface of a billiards table, said adhesive affinity being based upon a contact - type adhesive composition having a tackiness capable of repeatedly bonding to and separating from other surfaces.

5. The device of claim 1 wherein the upper side of said device contains a felt-like surface having frictional properties similar to those of the playing surface of a billiards table.

6. The device of claim 5, said felt-like surface having been produced by a floc deposition technique.

7. The device of claim 1 wherein said aiming pattern is comprised of paired elongated indicia diametrically opposed and equiangularly disposed about said central point.

8. The device of claim 7 wherein at least one pair of indicia is disposed perpendicular to said axis.

9. The device of claim 1 wherein said body portion has a width, measured perpendicular to said axis, smaller than the diameter of the generally circular boundary of said aiming pattern.

* * * * *